US009670772B2

(12) United States Patent
Bravard et al.

(10) Patent No.: US 9,670,772 B2
(45) Date of Patent: Jun. 6, 2017

(54) METHOD AND DEVICE FOR WELL COMMUNICATION

(71) Applicant: SERCEL, Carquefou (FR)

(72) Inventors: Nicolas Bravard, Toulouse (FR); Pascal Coince, Bourg Blanc (FR)

(73) Assignee: SERCEL, Carquefou (FR)

( * ) Notice: Subject to any disclaimer, the term of this patent is extended or adjusted under 35 U.S.C. 154(b) by 135 days.

(21) Appl. No.: 14/347,057

(22) PCT Filed: Sep. 25, 2012

(86) PCT No.: PCT/EP2012/068865
§ 371 (c)(1),
(2) Date: Mar. 25, 2014

(87) PCT Pub. No.: WO2013/045442
PCT Pub. Date: Apr. 4, 2013

(65) Prior Publication Data

US 2014/0233353 A1 Aug. 21, 2014

(30) Foreign Application Priority Data

Sep. 26, 2011 (EP) ..... 11182688

(51) Int. Cl.
*E21B 47/16* (2006.01)

(52) U.S. Cl.
CPC ..... *E21B 47/16* (2013.01)

(58) Field of Classification Search
CPC ..... E21B 47/16
(Continued)

(56) References Cited

U.S. PATENT DOCUMENTS 4,770,034 A * 9/1988 Titchener ..... E21B 47/12 340/854.3
6,188,647 B1 * 2/2001 Drumheller ..... B06B 1/0611 29/25.35

(Continued)

FOREIGN PATENT DOCUMENTS

EP 0773345 B1 4/2003
EP 2157278 A1 8/2008

(Continued)

OTHER PUBLICATIONS

International Preliminary Report on Patentability with Written Opinion of the International Searching Authority dated Apr. 1, 2014, issued in parent application No. PCT/EP2012/068865 (All the cited documents were previously provided in the IDS filed Mar. 25, 2014).

(Continued)

*Primary Examiner* — Amine Benlagsir
(74) *Attorney, Agent, or Firm* — Patent Portfolio Builders PLLC

(57) ABSTRACT

The present invention concerns a method and a well string element for transmitting data in a well. The well string element (20*c*) includes an elongated body (80) that defines a through channel (110) and also includes a side pocket (92) that is open to ambient (91); and an acoustic modem (60) provided in the pocket (92) and configured to emit acoustic waves. The acoustic modem (60) is configured to receive electrical signals from one or more sensors (50, 52), transform the electrical signals into the acoustic waves and emit the acoustic waves into a wall (112) of the elongated body (80) when receiving an acoustic wake-up call from a device (70) outside the drill string element (20*c*).

18 Claims, 10 Drawing Sheets

(58) Field of Classification Search
USPC ..... 367/82
See application file for complete search history.

(56) References Cited

U.S. PATENT DOCUMENTS

| | | | | |
|---|---|---|---|---|
| 8,302,685 | B2 | 11/2012 | Reyes et al. | |
| 2002/0020533 | A1 | 2/2002 | Tubel | |
| 2009/0071645 | A1 | 3/2009 | Kenison et al. | |
| 2009/0289808 | A1* | 11/2009 | Prammer | E21B 17/003 340/853.7 |
| 2011/0120701 | A1* | 5/2011 | Hall | E21B 17/00 166/242.1 |
| 2011/0176387 | A1* | 7/2011 | Froelich | E21B 47/16 367/82 |
| 2012/0051188 | A1* | 3/2012 | Graber | G10K 9/13 367/175 |

FOREIGN PATENT DOCUMENTS

| | | | | |
|---|---|---|---|---|
| VG | EP 0773345 | B1 * | 4/2003 | E21B 47/121 |
| WO | 92/06278 | A1 | 4/1992 | |
| WO | 98/48140 | A1 | 10/1998 | |
| WO | 02/27139 | A1 | 4/2002 | |
| WO | 03/067029 | A1 | 8/2003 | |

OTHER PUBLICATIONS

International Search Report dated Oct. 24, 2012, issued in parent application No. PCT/EP2012/068865.

J.E. Martin et al., "The Behaviour of a Seismic Vibrator Using Different Phase Control Methods and Drive Levels", First Break, vol. 8, No. 11, Nov. 1990, paged 404-414.

Russian Office Action in corresponding Russian Application No. 2014116909 dated Apr. 7, 2016. (All references were previously in an Office Action dated Nov. 4, 2015, with the exception of US 2009/0071645 A1.)

Search Report in corresponding Chinese Application No. 201280034001.7 issued Nov. 4, 2015. (Reference EP 0773345 A1 was cited in an Information Disclosure Statement submitted on Mar. 25, 2014.).

Russian Office Action in corresponding Russian Application No. 2014116909 dated Jun. 6, 2016. (References WO9206278A1 and EP0773345A1 were submitted with an Information Disclosure Statement on Mar. 25, 2015; US2009/0071645A1 was submitted with an Information Disclosure Statment on May 4, 2016.)

Chinese Office Action in corresponding Chinese Application No. Cn201280034001.7 issued Jun. 29, 2016. (Reference EP0773345A1 was submitted with an Information Disclosure Statement on Mar. 25, 2015.)

* cited by examiner

METHOD AND DEVICE FOR WELL COMMUNICATION

TECHNICAL FIELD

Embodiments of the subject matter disclosed herein generally relate to methods and systems and, more particularly, to mechanisms and techniques for transmitting data from a well.

DISCUSSION OF THE BACKGROUND

During the past years, interest in developing new oil and gas production fields has dramatically increased. However, the availability of land-based production fields is limited. Thus, the industry has now extended drilling to offshore locations, which appear to hold a vast amount of fossil fuel. Drilling is a complicated process that requires knowledge of pressures and temperatures (and other parameters) at the bottom of a well.

There are two types of situations when the pressures and temperatures of a well need to be monitored. The first situation is when the well is still being drilled, i.e., there is a drill line that runs through the well, and there is a drill bit at the end of the drill line for extending the well. In this case, as disclosed for example in U.S. patent application Ser. No. 12/363,092, the entire content of which is incorporated herein by reference, there is a continuous column of mud flowing from the drill bit to the surface of the rig. Using this continuous column of mud, a method of mud pulse telemetry data modulation (e.g., acoustic waves that propagate through the column) may be used to transmit information between sensors and computers located on the rig and various sensors (gauges) located in the well.

A second situation appears when the well is in the production phase, i.e., the drilling has been concluded and the well is used to extract oil and/or gas. For this phase, in order to know what is happening with the well, i.e., is there enough pressure to bring the oil or gas to the surface, etc., a monitoring system may be installed down the well. Such a monitoring system may be a downhole pressure and temperature gauge system. Other types of monitoring systems may be used that monitor more or fewer parameters of the well.

A downhole pressure and temperature gauge system in the well may provide its operator with real-time data and knowledge from the reservoir, and actions can be taken to improve reservoir drainage, lift performance, etc. When such changes are performed, the downhole sensing system verifies that the action decided by the operator has the required effect on the reservoir drainage. Thus, downhole sensing is advantageous for increasing drainage from the reservoir and saving costs by not having to perform downhole intervention surveys.

In other words, the gauge systems provide the operator with improved reservoir management, leading to increased daily production and increased total field drainage, better reservoir characterization, improved production optimization, better flow allocation and a real-time tool for well diagnostics.

However, there is a problem when the well is not active (a well is not active for various reasons) because a valve (e.g., downhole safety valve or other valves) in the well is closed and thus, there is no continuous column of fluid from the bottom of the well to the rig or Christmas tree. In this situation, the above-noted solution of using mud pulse telemetry might not work. Some existing solutions use, for example, a modified testing valve, and the pressure and temperatures can be read by an electric line device with communication based on an inductive coupling. Another solution is to use electromagnetic waves in a wireless manner or to use acoustic waves that are repeated up to the surface by plural repeaters for transmitting the information from the well to the surface.

The drawbacks of these existing solutions are that their implementations are cumbersome and not that reliable. The wireless solution highly depends on underground resistivity and seems not to work offshore. Alternatively, the use of modified testing tools or repeaters imposes a complex completion and requires highly-trained operators. In addition, the implementation of these solutions is costly.

OBJECTIVES OF THE INVENTION

Thus, there is a need in the industry to provide a simple, reliable and cost-effective system capable of transmitting data from the well to the surface even if a valve in the well is closed.

The existing systems for transferring data across a well line, from the well to the surface, are cumbersome, prone to failures, or required complicated equipment. Thus, there is a need to provide a simple and reliable communication system between various parts of the well and the surface.

SUMMARY OF THE INVENTION

These objectives, as well as others that will emerge hereinafter, are at least partially achieved by virtue of the invention, an object of which is a well string element comprising:

- an elongated body that defines a through channel and also includes a side pocket that is open to ambient; and
- an acoustic modem provided in the pocket and configured to emit acoustic waves, wherein the acoustic modem is configured to receive electrical signals from one or more sensors, transform the electrical signals into the acoustic waves indicative of various parameters measured by sensors connected to the acoustic modem, and emit the acoustic waves into a wall of the elongated body when receiving an acoustic wake-up call from a device outside the drill string element.

The well string element may be a drill string element or test string element or a production string element.

The well string element may further comprise a sleeve configured to cover the pocket and seal the acoustic modem from the ambient.

The well string element may have a cylindrical shape and the acoustic modem may have a semi-cylindrical shape.

In a particular embodiment, the well string element further comprises:

- a battery provided in the elongated body; and
- a sensor configured to sense well parameters and provided in the elongated body, wherein the sensor is electrically connected to the acoustic modem.

In this case, the well parameters may include one of a temperature or a pressure.

The well string element may further comprise a memory connected to the acoustic modem and configured to store data recorded by the one or more sensors.

The acoustic modem may comprise a ceramic element configured to oscillate to produce the acoustic waves, and the ceramic element may be directly attached to the elongated body.

An inside of the acoustic modem may be maintained at substantially 1 atm. when undersea.

In other words, according to an exemplary embodiment, there is a well string element that includes an elongated body that defines a through channel and also includes a side pocket that is open to ambient; and an acoustic modem provided in the pocket and configured to emit acoustic waves. The acoustic modem is configured to receive electrical signals from one or more sensors, transform the electrical signals into the acoustic waves indicative of various parameters measured by sensors connected to the acoustic modem, and emit the acoustic waves into a wall of the elongated body when receiving an acoustic wake-up call from a device outside the drill string element.

Another object of the invention, independently or in combination with the above, is a well communication system configured to transmit data across a closed valve inside the well, the system comprising:

an acoustic modem provided in a body of a well string element and configured to transmit acoustic waves into a wall of the well string element, wherein the acoustic waves are indicative of various parameters measured by sensors connected to the acoustic modem; and a receiving device configured to communicate through acoustic waves with the acoustic modem, the receiving device being configured to be lowered into a medium in the well with a cable and to be positioned upstream a valve provided in a well line, wherein the acoustic waves propagate from the acoustic modem to the wall of the drill string element, the valve, the medium, and the receiving device.

In one embodiment, the well string element has a cylindrical shape and the acoustic modem has a semi-cylindrical shape.

The well string element may further comprise:

a battery provided in the elongated body; and a sensor configured to sense well parameters and provided in the elongated body, wherein the sensor is electrically connected to the acoustic modem.

The well string element may further comprise a memory connected to the acoustic modem and configured to store data recorded by the one or more sensors.

In one particular embodiment, the acoustic modem comprises a ceramic element configured to oscillate to produce the acoustic waves, and the ceramic element is directly attached to the elongated body.

The well string element may be in direct contact with the valve.

In one particular embodiment, the receiving device comprises:

a transceiver configured to emit and receive the acoustic waves; and a memory configured to store the acoustic waves.

The receiving device may be configured to transform the received acoustic waves into electrical signals and transmit in real time the electrical signals upstream on the cable.

The valve may be closed.

The acoustic modem may be a sleeping mode and the receiving device may be configured to wake up the acoustic modem for transmitting the acoustic waves.

In other words, according to another exemplary embodiment, there is a well communication system configured to transmit data across a closed valve inside the well. The system includes an acoustic modem provided in a body of a well string element and configured to transmit acoustic waves into a wall of the well string element, wherein the acoustic waves are indicative of various parameters measured by sensors connected to the acoustic modem; and a receiving device configured to communicate through acoustic waves with the acoustic modem, the receiving device being configured to be lowered into a medium in the well with a cable and to be positioned upstream a valve provided in a well line. The acoustic waves propagate from the acoustic modem to the wall of the drill string element, the valve, the medium, and the receiving device.

Another object of the invention, independently or in combination with the above, is a method for transmitting data from sensors to a surface of a well in which the sensors are provided, the method comprising:

recording measurements related to the well with one or more sensors provided in the well;

having an acoustic modem provided in the well, in a vicinity of the sensors, in a sleeping mode;

receiving a wake-up signal at the acoustic modem from a receiving device also provided in the well, wherein the receiving device is separated from the acoustic modem by a closed valve;

receiving the measurements from the one or more sensors at the acoustic modem;

transmitting acoustic waves from the acoustic modem to the receiving device through the valve, wherein the acoustic signals are indicative of the measurements of the one or more sensors; and receiving at the receiving device the acoustic signals.

In other words, according to still another exemplary embodiment, there is a method for transmitting data from sensors to a surface of a well in which the sensors are provided. The method includes a step of recording measurements related to the well with one or more sensors provided in the well; a step of having an acoustic modem provided in the well, in a vicinity of the sensors, in a sleeping mode; a step of receiving a wake-up signal at the acoustic modem from a receiving device also provided in the well, wherein the receiving device is separated from the acoustic modem by a closed valve; a step of receiving the measurements from the one or more sensors at the acoustic modem; a step of transmitting acoustic waves from the acoustic modem to the receiving device through the valve, wherein the acoustic signals are indicative of the measurements of the one or more sensors; and a step of receiving at the receiving device the acoustic signals.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION OF EXEMPLARY EMBODIMENTS

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of completed wells whose temperatures and pressures are monitored. However, the embodiments to be discussed next are not limited to this structure, but may be applied to other structures that need to communicate data through a closed valve.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an exemplary embodiment, there is a well string element that has an elongated body that defines a through channel. The well string element may be a drill, test or production string. A fluid may pass through the channel as necessary. The elongated body may include a side pocket, e.g., a wedge or a chamber that is open to the ambient. An acoustic modem is provided in the pocket and configured to emit acoustic waves. A sleeve covers the pocket and seals the acoustic modem from the ambient. The acoustic modem is configured to receive information (e.g., analog or digital signals) from one or more sensors, which are downstream or upstream from the acoustic modem, to modulate the information to generate acoustic waves and to emit the acoustic waves into the elongated body. The acoustic modem is configured to be in sleep mode and wakes up when receiving an acoustic wake-up signal from a device outside the drill string element. Various features of the drill string element are now discussed in more detail.

Figure 1:
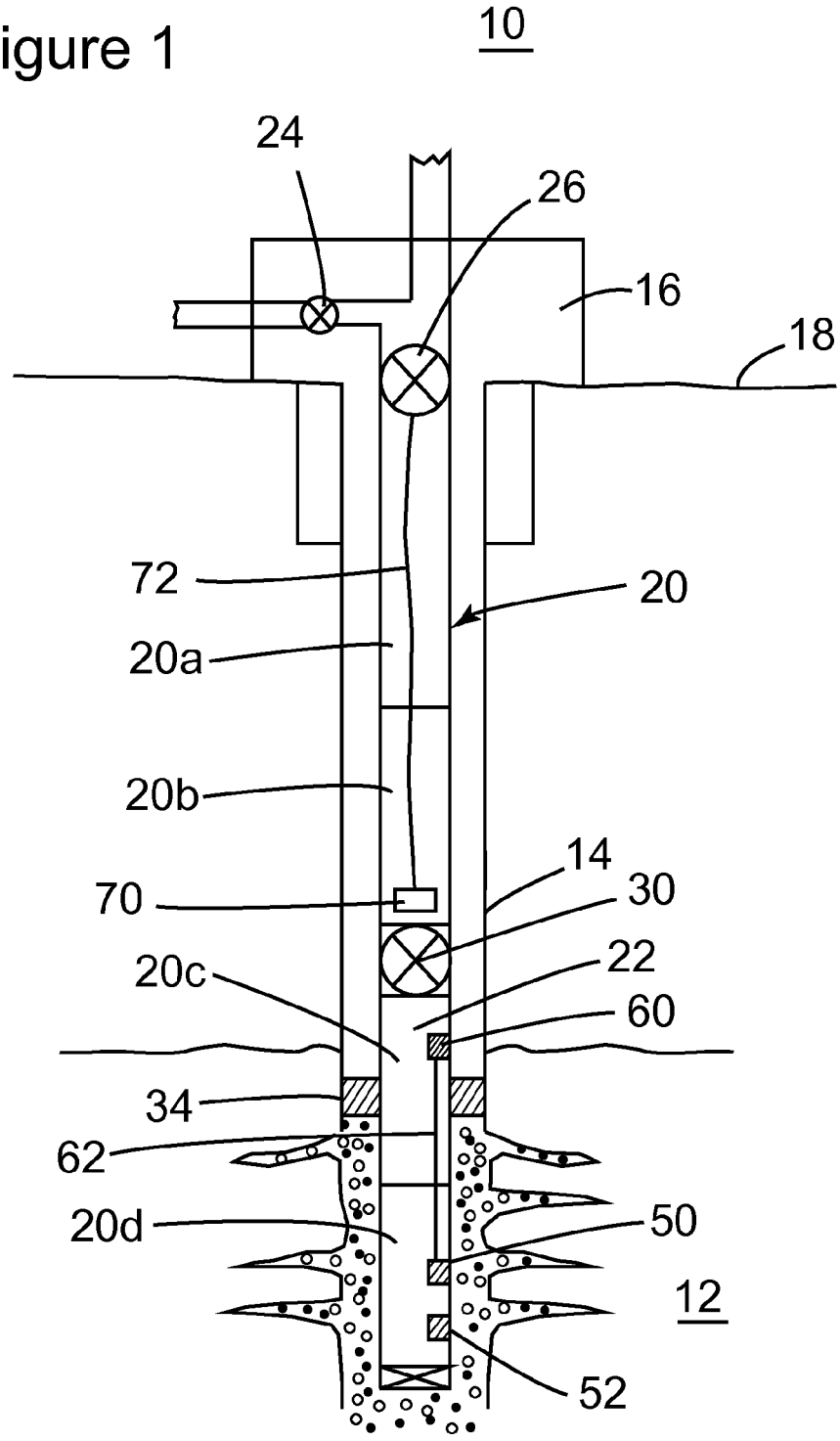
FIG. 1 is a schematic diagram of a production well.

According to an exemplary embodiment illustrated in FIG. 1, a production well 10 for extracting oil and/or gas from a reservoir 12 includes a casing 14 that may extend from the reservoir 12 to a Christmas tree 16. However, the casing 14 may be shorter and not reach the reservoir. The Christmas tree 16 may be placed on the sea bed 18 if the well is undersea. A drill line 20 extends from the Christmas tree 16 to the reservoir 12. In the following, for simplicity, reference to the drill line 20 is made. However, line 20 may be a test line or a production line or any other line that is known in the art. The drill line 20 is formed from individual drill string elements 20*a-d* that connect to each other to form a conduit 22 through which the oil or gas (or other substance) may flow to the surface.

Various valves are provided for controlling the flow of fluids in the casing 14 and the drill line 20. FIG. 1 shows examples of such valves 24 and 26 provided in the Christmas tree. Another valve 30 is provided in the drill line 20 for controlling the flow of fluid in the drill line. The valve 30 may be hydraulically, electrical or acoustically controlled from the surface. Drill packers 34 may be used to position the drill line 20 relative to the casing 14 and also to prevent a flow of fluids between the drill line and the casing 14, i.e., in the annulus.

As discussed earlier, there is a need to monitor the reservoir for various reasons; thus, sensors or gauges are placed in the well. Such sensors may be provided in one or more drill string elements and they measure various parameters. For example, the sensors may measure the pressure and temperature. For example, FIG. 1 shows a pressure sensor 50 and a temperature sensor 52 in the drill string element 20*d*. In one application, these sensors or additional sensors may be placed in the drill string element 20*c*. To receive the information from these sensors, electrical wires may be run all the way up to the Christmas tree. However, this is not advantageous, as already discussed. Another way is to use the fluid in the drill line 20 for sending acoustic waves from the sensors to the Christmas tree. This last approach is imperiled when the valve 30 is closed, as the continuity of the fluid column is severed.

Figure 3:
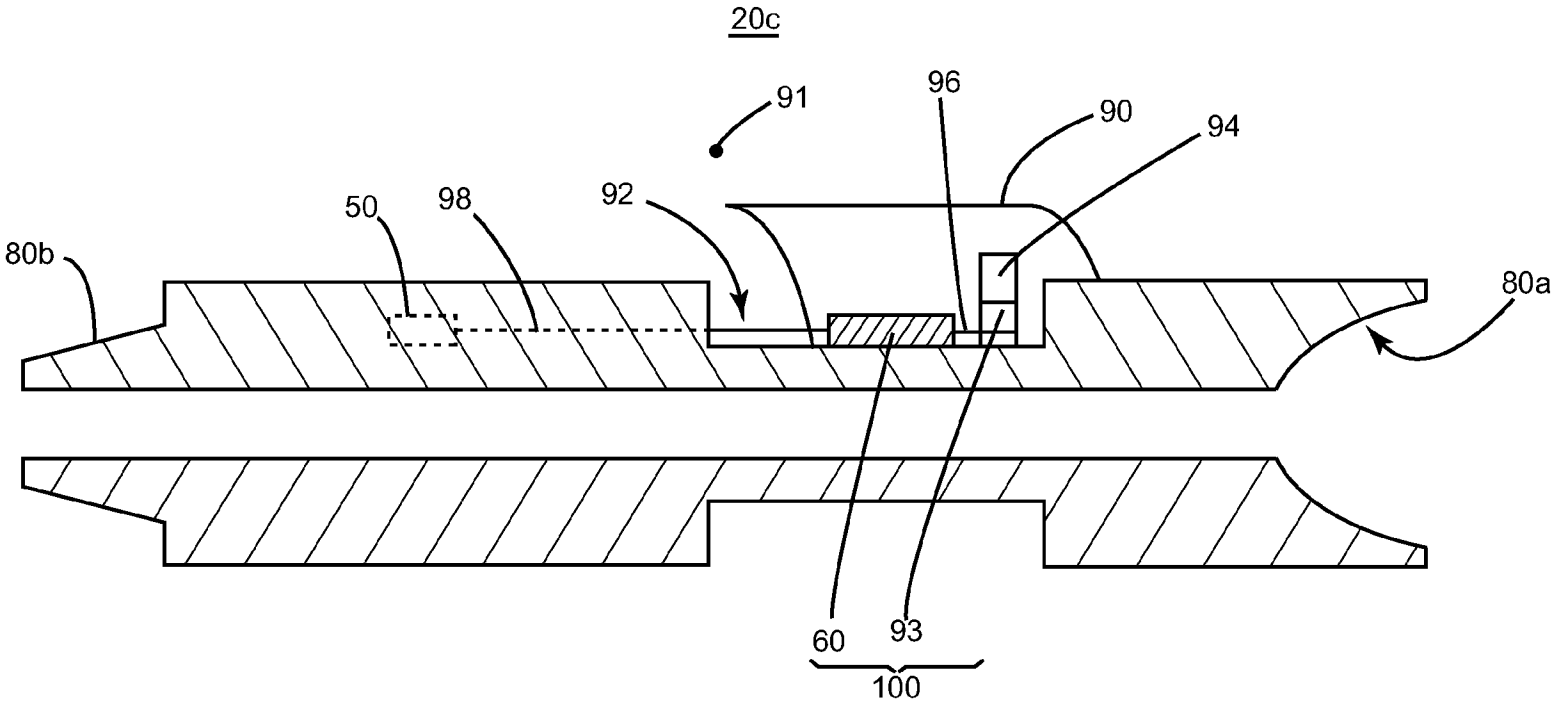
FIG. 3 is a cut-through section of a drill string element with an acoustic modem according to an exemplary embodiment.

Thus, according to an exemplary embodiment, an acoustic modem 60 may be provided in a drill string element 20*c* and electrically connected through wires 62 with the sensors 50 and 52 (as later described in FIG. 3). This configuration is advantageous because all the wires between the sensors and the acoustic modem are integrated inside the corresponding drill string element 20*c*. Thus, there are no wires that go through two distinct drill string elements, unlike the configuration shown in FIG. 1. Therefore, most of the problems associated with the use of wires (like wire 62 in FIG. 1) are avoided. Of course, the acoustic modem 60 may be connected otherwise to the sensors. In this way, the data from the sensors 50 and 52 is electrically transmitted to the acoustic modem 60. The acoustic modem 60 or associated electronics is configured to transform the information from the sensors into acoustic waves and emit the acoustic waves in the wall (skin) of the drill string element 20*c*. The drill string element 20*c* may be in direct contact with the valve 30 or separated by one or more drill string elements.

However, once an oscillating part (ceramic part) of the acoustic modem 60 starts to generate acoustic waves, the acoustic waves propagate through the walls of the drill string elements and then through the body of the valve, i.e., through a metallic medium. As no repeaters or amplifiers of the acoustic waves are used, a receiving device capable of recording the acoustic waves after propagating through the closed valve 30 is provided. Such receiving device 70, e.g., a memory upload module (MUM), may be provided inside the drill line 20 or inside the casing 14 and outside the drill line 20. FIG. 1 shows a MUM 70 provided inside the drill line 20 and hanging from a cable 72 that extends from the Christmas tree 16. Thus, a MUM 70 may be lowered at the operator's convenience into the well and may be configured to wake up the acoustic modem 60 for transmitting information from the sensors. Alternatively, a MUM 70 may be permanently kept in the well to provide live data about the well. The data from MUM 70 may be brought to the surface through an electrical line or other means known in the art.

Figure 2:
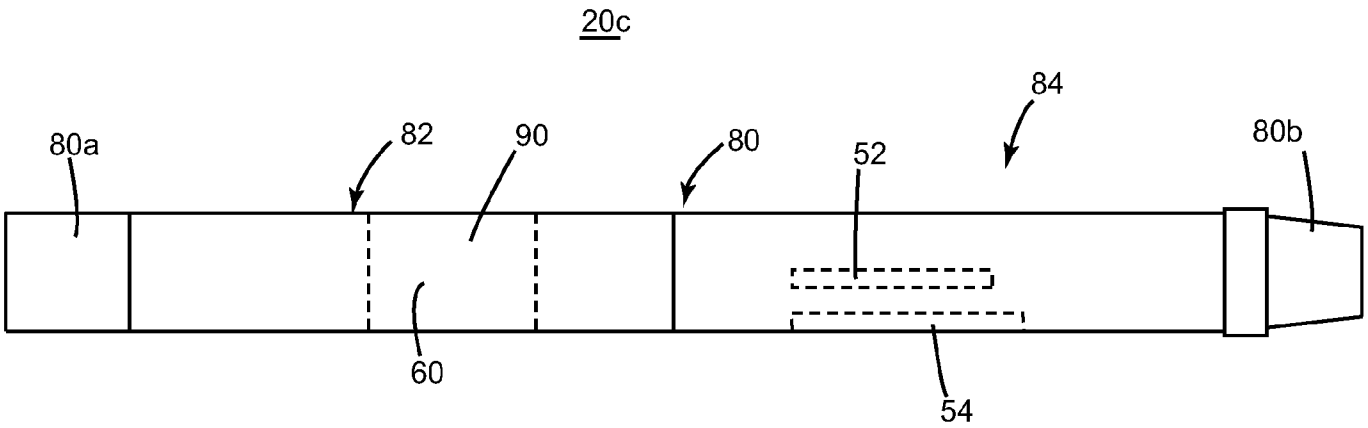
FIG. 2 is a schematic diagram of a drill string element having an acoustic modem according to an exemplary embodiment.

Some elements of the generic mechanism discussed above are now discussed in more detail. FIG. 2 shows the drill string element 20*c* having an elongated body 80. The body 80 has first and second ends 80*a* and 80*b* that are configured to connect to other drill string elements. The body 80 is divided into a first region 82 that includes the acoustic modem 60 and other components, and a second region 84 that includes, for example, temperature and/or pressure sensors 52 and 54. As noted above, other type of sensors may be present. More or fewer sensors may be provided on the drill string element 20*c*. In one application, all the sensors are provided on adjacent drill string elements (for example, drill string 20*d* in FIG. 1). In still another application, another type of sensors is provided on the drill string element 20*c*.

Returning to the first region 82, the acoustic modem 60 is not directly visible because it is being covered by a sleeve 90 in FIG. 2. However, when the sleeve 90 is removed, the acoustic modem 60 is exposed to an ambient 91 of the drill string element as shown in FIG. 3. The sleeve 90 may be configured to seal a pocket 92 or chamber formed in a wall of the drill string element 20*c* from the ambient 91. The sleeve 90 may be attached to the body 80 in any known way, for example, screwed, bolted, glued or welded to the body 80. The pocket 92 is shown in FIG. 3 and is configured to accommodate the acoustic modem 60. In FIG. 3, the sleeve 90 is shown slightly detached from the body 80. This figure also shows a memory unit 93 and an optional control unit 94 (e.g., a processor) that are electrically connected to the acoustic modem 60 through a cable 96. These elements may be part of the acoustic modem 60. Further, the figure shows that these elements are also electrically connected through a cable 98 to the sensor 50. As discussed earlier, the sensor 50 may not be present on the drill string element (drill string 20*c* as described in FIG. 3) that houses the acoustic modem 60. Sensor 50 can be present on an adjacent drill string element 20*d* as shown in FIG. 1.

The memory unit 93 together with the acoustic modem 60 may form a data acquisition device (DAD) 100. A DAD 100 is configured to couple to a MUM 70 as discussed next. Optionally, a DAD 100 may include the control unit 94. In one application, the memory unit 93 and the control unit 94 (or controller 94) are incorporated into the acoustic modem 60. The DAD 100 may be configured to receive data from more than one sensor 50. In one application, multiple drill string elements may be configured to include a DAD and corresponding sensors. Therefore, the drill line may have plural DADs that are configured to communicate with a same MUM. Thus, the number of sensors deployed in the drill line is increased and this configuration allows the operator to determine which part of well works better than other parts as the drill string elements having corresponding DADs and sensors may be located at different depths of the well.

Figure 4:
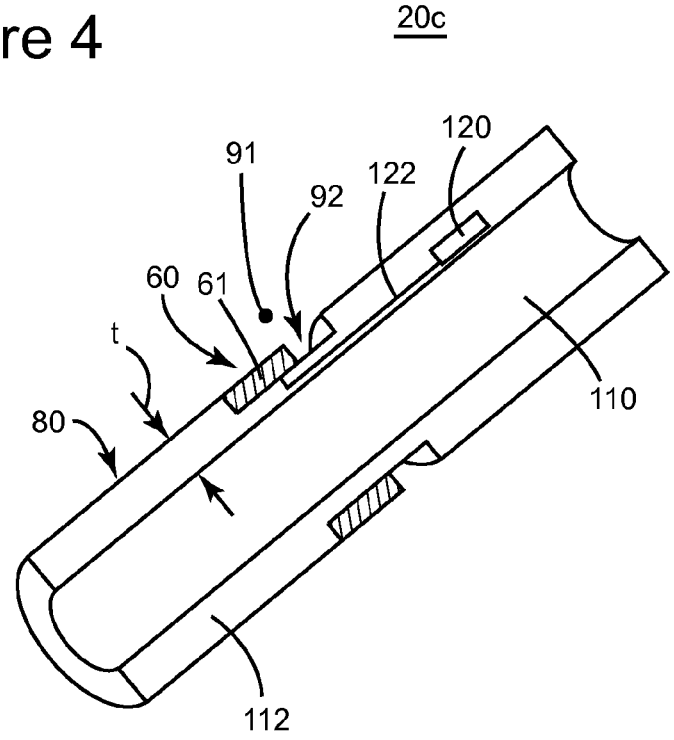
FIG. 4 is a cut-through section of a drill string element with an acoustic modem and a battery according to an exemplary embodiment.

In one exemplary embodiment illustrated in FIG. 4, a cut-through of the drill string element 20*c* is shown. This figure shows a channel 110 that extends all the way through the drill string element 20*c* and also shows a thickness "t" of a wall 112 of the body 80. The acoustic modem 60 includes a ceramic part 61 that may have a shape that resembles half of a cylinder. In other words, the ceramic 61 does not have to be all the way around the body 80. However, the shape of the ceramic may vary depending on various factors. FIG. 4 also shows a battery 120 provided in the body 80 of the drill string element 20*c*. A cable 122 provides electrical power from the battery 120 to the DAD 100. Pocket 92 may accommodate other electronic components that are typically associated with an acoustic modem, as will be appreciated by those skilled in the art.

According to an exemplary embodiment, the acoustic modem 60 and/or the controller 94 may coordinate the way in which information from the sensors is received, stored and transmitted to the MUM 70. For example, the sensors may provide, at predetermined time intervals, electrical signals indicative of the quantities that are being sensed (e.g., temperature and pressure). These values may be stored in the memory unit 93. At a time when the MUM 70 wakes up the DAD 100, the processor 94 and/or acoustic modem 60 transforms/modulates electrical signals stored in the memory into acoustic signals and sends the acoustic signals into the wall 112 of the body 80. This process may continue until all the data from the memory unit 93 has been transmitted, at which time the memory unit 93 is emptied and prepared to receive new data from the sensors. Further, the acoustic modem 60 may be asked (by the MUM) to enter sleep mode until the memory unit 93 is receiving more data or until the MUM again wakes up the DAD. In this way, electrical power is conserved.

Figure 5:
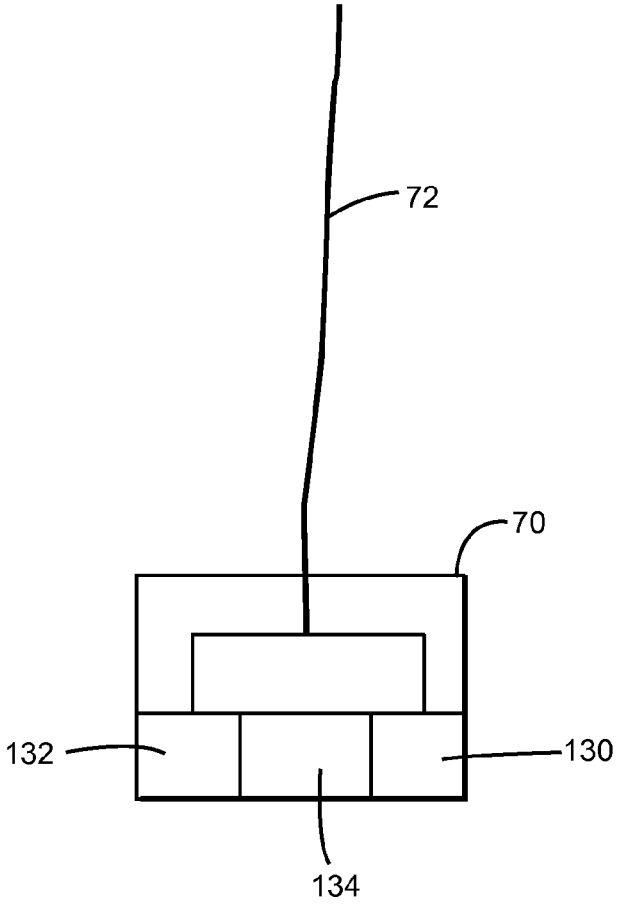
FIG. 5 is a schematic diagram of a receiving device configured to communicate with an acoustic modem according to an exemplary embodiment.

For achieving its part of the data transmission, the MUM 70, as shown in FIG. 5, includes a memory 130 for receiving and storing the data from the DAD 100. In addition, the MUM 70 may include a transceiver 132 that is configured to exchange acoustic signals with the DAD 100. The transceiver 132 may be an acoustic modem having functionalities similar to modem 60. The MUM 70 also may include a processor 134 configured to control when the transceiver 132 wakes up the DAD 100 and also coordinates the storage of data in memory 130. In one application, the processor 134 is configured to continuously send the data from the DAD 100, through cable 72, to the operator of the well. Thus, cable 72 is configured to exchange not only data, but also power between the surface and the MUM 70. In addition, cable 72 is configured to withstand enough mechanical tension to support the MUM 70.

Figure 6:
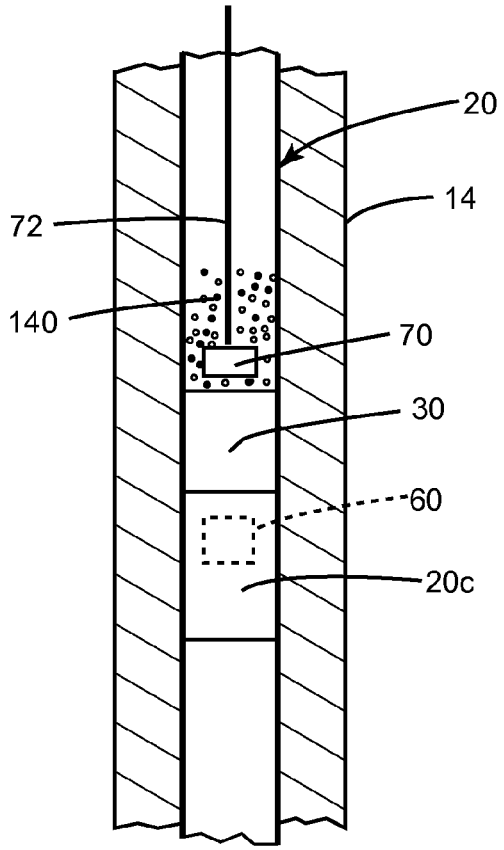
FIG. 6 is a schematic diagram of a system for transmitting information past a closed valve in a well according to an exemplary embodiment.

Having described individually the MUM and DAD, it is now appropriate to describe the functionality of these two elements together. FIG. 6 is a schematic diagram indicating the closed valve 30 of the drill line 20. The acoustic modem 60 of the DAD 100 is provided in the drill string element 20*c*. It is noted that the drill string element 20*c* does not have to be in direct contact with valve 30. However, it is preferred that the acoustic modem be as close as possible to the valve. FIG. 6 also shows the MUM 70 lowered in the drill line. However, the MUM may be lowered in the casing 14, outside the drill line.

Above the valve 30 is a medium 140 that may include one or more of gas, oil, water or other substances normally found in a well. Thus, the MUM 70 interfaces with the medium 140. In one application, the MUM 70 may be in direct contact with the valve 30, the casing 14 or the drill line 20. In this position, a wake-up acoustic signal is generated by the MUM. The signal propagates through the medium 140, through the metallic valve 30 and thorough the wall 112 of the drill string element 20*c* until arriving at the acoustic modem 60. A ceramic element (not shown) of the acoustic modem 60 picks up the acoustic signal and the controller 94 (e.g., a processor) of the acoustic modem 60 compares it with a pre-stored reference signal. If there is a match, the components of the acoustic modem are activated. This is one method for waking up the DAD. However, there are other methods in the art (e.g., detection of energy level) and one skilled in the art would know how to implement such other methods.

Having awoken the DAD 100, the processor 94 of the acoustic modem 60 in the drill spring element 20*c* processes electrical signals from memory unit 93 and transmits them as acoustic signals through the wall 112 of the drill string element 20*c*, valve 30 and medium 140 to the MUM 70. The transceiver 132 receives these acoustic signals and, after decoding them (e.g., transforming them back to electrical signals), either sends them through the cable 72 to the operator of the well or stores them in memory 130.

Figure 7:
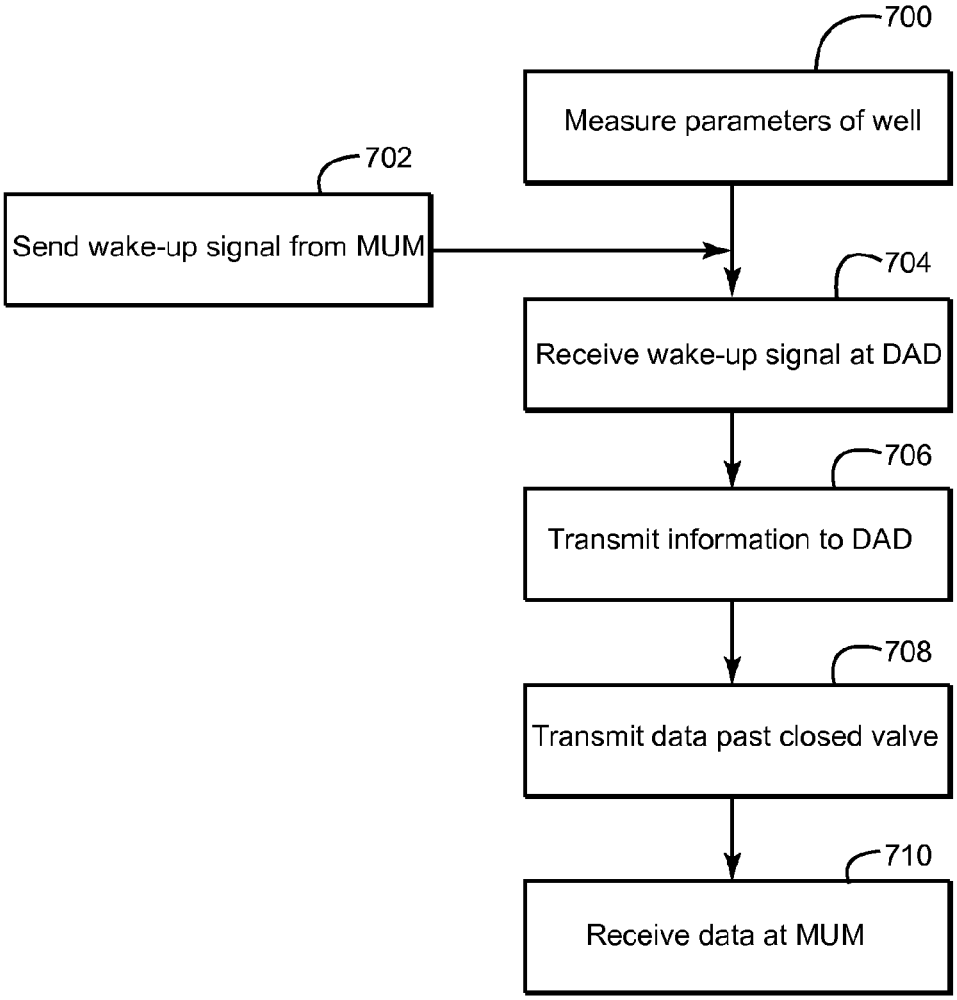
FIG. 7 is a flowchart of a method for transmitting information past a closed valve in well according to an exemplary embodiment.

The above operations of the MUM 70 and DAD 100 may be summarized with regard to the flowchart shown in FIG. 7. According to this figure, various sensors are measuring in step 700 corresponding parameters of the well. For example, sensor 50 measures the pressure of the well and sensor 52 measures the temperature of the well. In step 702, the MUM 70 is instructed to send a wake-up signal (or any other signal like test signal or control signal) to the DAD 100. It is noted that a control signal sent to the DAD 100 may be used not only to control the components of the DAD but also the sensors connected to the DAD. Given the fact that the MUM 70 is behind a closed valve 30, there might not be a continuous fluid column between the MUM 70 and DAD 100. As the wake-up signal may be a sound signal, the sound signal propagates through the closed valve 30 into the drill string element where the acoustic modem 60 of the DAD 100 is present. Thus, in step 704, the DAD receives the wake-up sound signal from the MUM and activates the components of the DAD. At this time, data from the sensors are transmitted in step 706, for example, through a dedicated wire, to the DAD 100. The DAD 100 may store this information in the memory unit 93.

This activation process results in converting electrical signals stored in the DAD's memory into acoustic signals and emitting in step 708 those acoustic signals, by the acoustic modem 60, into the wall of the drill string element housing the acoustic modem. As this drill string element is in direct contact with the valve or close to it, acoustic waves are transmitted through the wall of the drill line and the valve far enough to be received by the MUM in step 710. The MUM 70 can store the received information locally, in memory, after converting the acoustic signals back into electrical signals, or may transfer in real time the electrical signals to the operator of the well.

Figure 8:
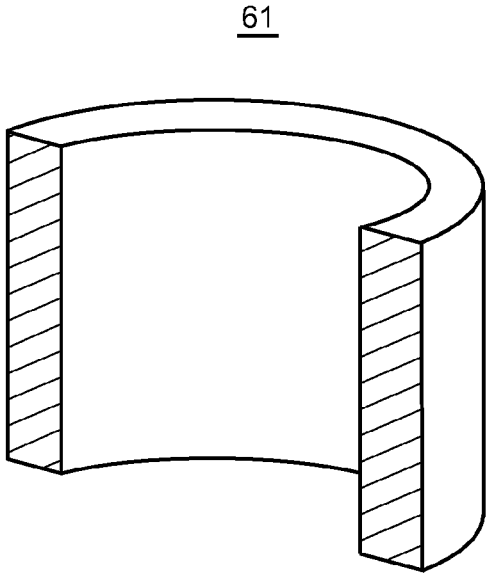
FIG. 8 is a schematic diagram of a ceramic element of an acoustic modem according to an exemplary embodiment.

In one application, the data recorded by the sensors is stored at the sensors in the drill line, and when the MUM wakes-up the DAD, the DAD instructs the sensors to send their data to the acoustic modem and then to the MUM. In another application, the acoustic modem 60 includes a piezo-electric ceramic element 61 that is configured to generate ultrasonic pressure waves. As the ceramic element is close or in direct contact with a wall of the drill string element, acoustic waves produced by the ceramic element directly propagate through the wall of the drill string element. A ceramic element 61 may have the shape shown in FIG. 8, i.e., a semi-cylinder configured to fit inside pocket 92 of the drill string element 20*c* of FIG. 3.

Figure 9:
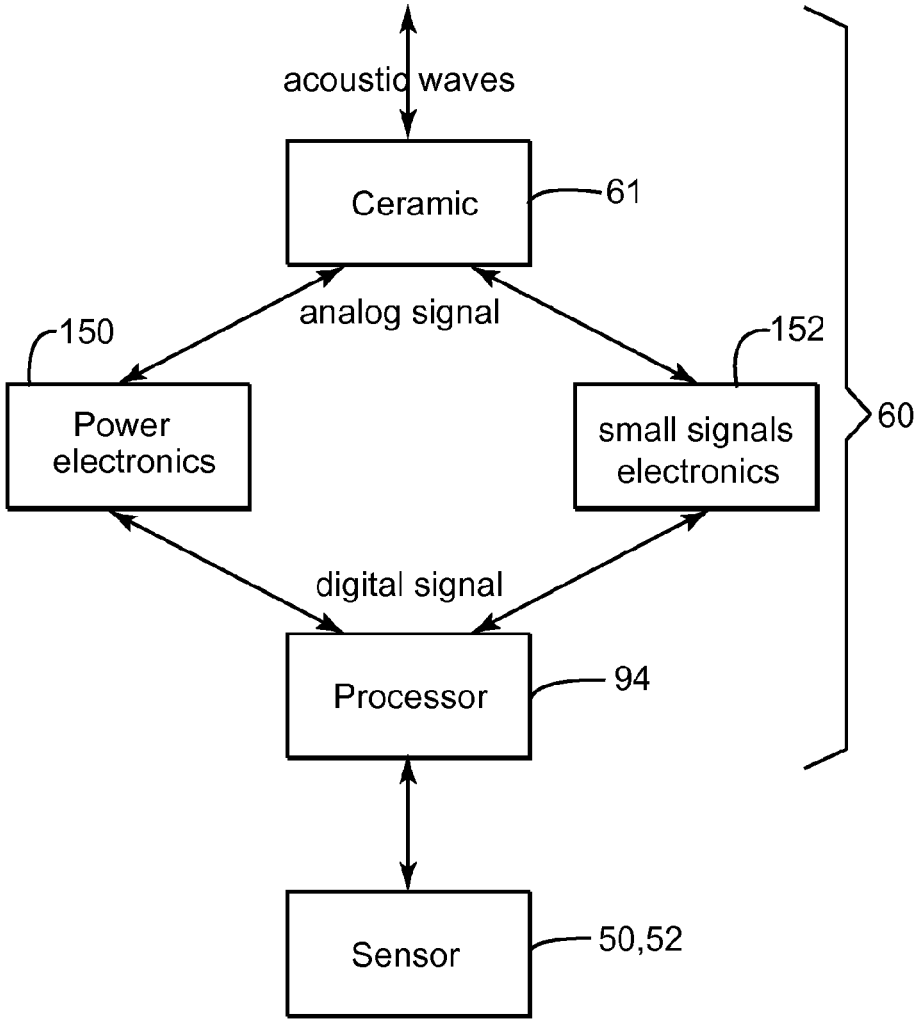
FIG. 9 is a schematic functional diagram of an acoustic modem.

The functionality of the acoustic modem 60 is now discussed and also illustrated in FIG. 9. The acoustic modem 60 may include, as already discussed above, the ceramic 61 and the processor/controller 94. Further, the acoustic modem 60 may include a power electronics module 150 and a small signals electronics module 162. Of course, the acoustic modem 60 may have a different configuration as known in the art. When acoustic waves are received at the ceramic 61, an analog signal is generated by the ceramic 61 and sent to the small signals electronics module 152 for being transformed into digital signals. The digital signals are then transmitted to the processor 94 for demodulation and eventually to the sensor 50 or 52. These processes take place in the reception mode of the acoustic modem 60.

In the transmission mode, information from the sensor 50 or 52 is received at the processor 94 and modulated to create digital signals. The digital signals are then transmitted to the power electronics module 150 to generate electrical signals that are sent to the ceramic 61. Based on the electrical signals received from the power electronics module 150, the ceramic 61 emits the acoustic waves.

Because the MUM is above the closed valve 30, in order to improve its reception of the acoustic signals, the well may be filled with water or another fluid, as this medium promotes the propagation of acoustic waves.

The MUM and DAD described above may be used not only with new drill string elements, but also with the existing ones as the acoustic modem 60 may be implemented in existing pockets of the drill string elements. Also, the MUMs and DADs of the exemplary embodiments discussed above are more reliable than the existing well communication systems, have low power consumption, provide a robust communication protocol, and require low maintenance.

Figure 10:
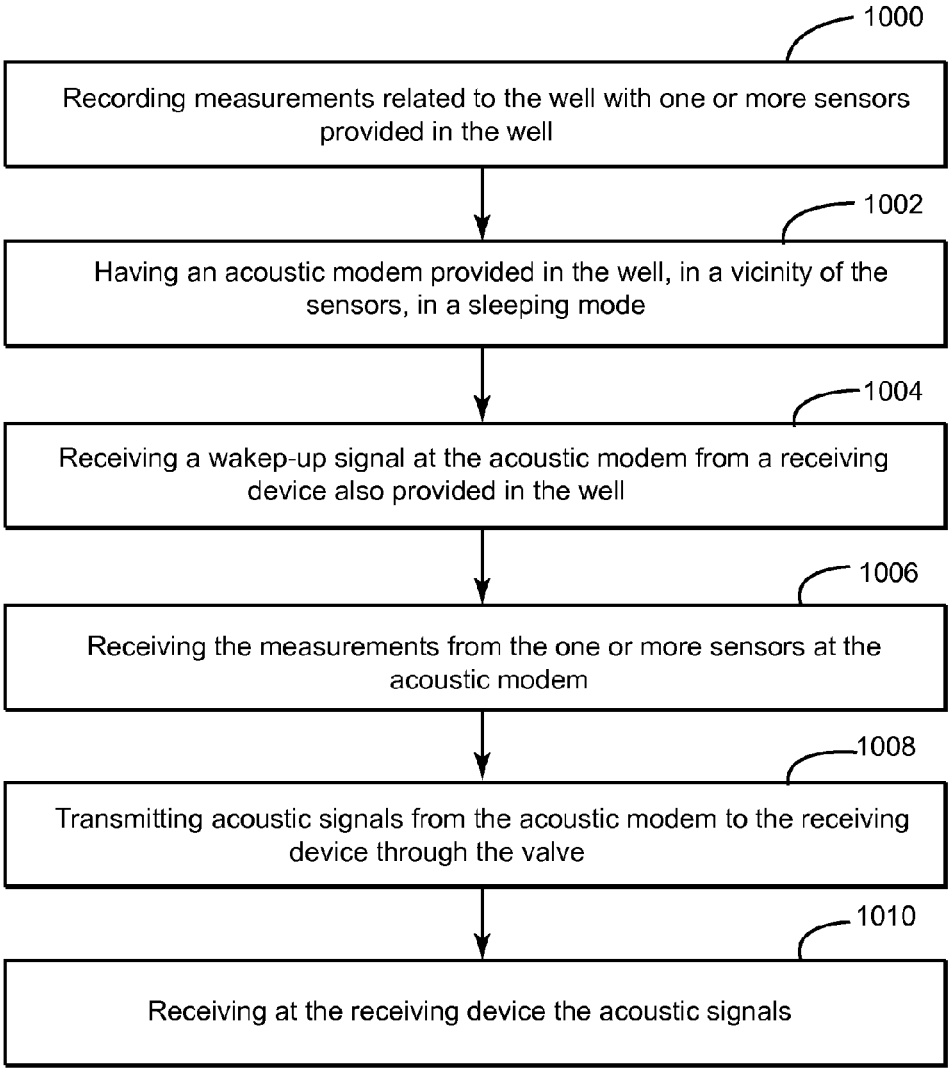
FIG. 10 is a flowchart of a method for transmitting information in a well according to an exemplary embodiment.

According to an exemplary embodiment, illustrated in FIG. 10, there is a method for transmitting data from sensors to the surface of a well in which the sensors are provided. The method includes a step 1000 of recording measurements related to the well with one or more sensors in the well; a step 1002 of having an acoustic modem in the well, in the vicinity of the sensors, in sleep mode; a step 1004 of receiving a wake-up signal at the acoustic modem from a receiving device also in the well, wherein the receiving device is separated from the acoustic modem by a closed valve; a step 1006 of receiving the measurements from the one or more sensors at the acoustic modem; a step 1008 of transmitting acoustic signals from the acoustic modem to the receiving device through the valve, wherein the acoustic signals are indicative of the measurements of one or more sensors; and a step 1010 of receiving the acoustic signals at the receiving device.

The disclosed exemplary embodiments provide a drill string element, a system and a method for transmitting recorded data past a closed valve. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The invention claimed is:

1. A line for oil and gas exploration comprising:

a well string element including, an elongated body that defines a through channel and also includes a side pocket that is open to ambient, and an acoustic modem provided in the pocket and configured to emit acoustic waves;

a valve provided in the well string element and the valve is upstream of the well string element; and a receiving device configured to communicate through the acoustic waves with the acoustic modem, the receiving device being configured to be lowered, with a cable, into a medium contained within the line, and to be positioned upstream the valve, wherein the acoustic modem is configured to receive electrical signals from one or more sensors, transform the electrical signals into the acoustic waves indicative of various parameters measured by the one or more sensors connected to the acoustic modem, and emit the acoustic waves into a wall of the elongated body when receiving an acoustic wake-up call from a device outside the well string element, and wherein the receiving device is not in direct contact with the line, and wherein the receiving device hangs freely from the cable while receiving the acoustic waves emitted by the acoustic modem through the medium, wherein the acoustic modem comprises a ceramic element configured to oscillate to produce the acoustic waves, and the ceramic element is directly attached to the elongated body.

2. The line of claim 1, wherein the well string element is a drill string element or test string element or a production string element.

3. The line of claim 1, further comprising a sleeve configured to cover the pocket and seal the acoustic modem from the ambient.

4. The line of claim 1, wherein the well string element has a cylindrical shape and the acoustic modem has a semi-cylindrical shape.

5. The line of claim 1, further comprising:

a battery provided in the elongated body; and a first sensor configured to sense well parameters and provided in the elongated body, wherein the first sensor is electrically connected to the acoustic modem.

6. The line of claim 5, wherein the well parameters include one of a temperature or a pressure.

7. The line of claim 1, further comprising a memory connected to the acoustic modem and configured to store data recorded by the one or more sensors.

8. The line of claim 1, wherein the acoustic modem is maintained undersea.

9. A well communication system configured to transmit data across a closed valve inside the well communication system, the well communication system comprising:

a well string element includes an elongated body that defines a through channel and also includes a side pocket that is open to ambient, the valve provided in the well string element and the valve is upstream of the well string element, an acoustic modem provided in the pocket of the well string element and configured to transmit acoustic waves into a wall of the well string element when receiving an acoustic wake-up call from a device outside the well string element, wherein the acoustic modem is configured to receive electrical signals from one or more sensors, transform the electrical signals into the acoustic waves, wherein the acoustic waves are indicative of various parameters measured by the one or more sensors connected to the acoustic modem, and a receiving device configured to communicate through the acoustic waves with the acoustic modem, the receiving device being configured to be lowered into a medium within the well string element with a cable, and the receiving device to be positioned upstream the valve provided in the well string element, wherein the acoustic waves propagate from the acoustic modem to the wall of the well string element, the valve, the medium, and the receiving device, wherein the receiving device is not in direct contact with the well string element, and the receiving device hangs freely from the cable while receiving the acoustic waves, and wherein the acoustic modem comprises a ceramic element configured to oscillate to produce the acoustic waves, and the ceramic element is directly attached to the elongated body of the well string element.

10. The system of claim 9, wherein the well string element has a cylindrical shape and the acoustic modem has a semi-cylindrical shape.

11. The system of claim 9, wherein the well string element further comprises:

a battery provided in the elongated body; and a first sensor configured to sense well parameters and provided in the elongated body, wherein the first sensor is electrically connected to the acoustic modem.

12. The system of claim 9, wherein the well string element further comprises a memory connected to the acoustic modem and configured to store data recorded by the one or more sensors.

13. The system of claim 9, wherein the well string element is in direct contact with the valve.

14. The system of claim 9, wherein the receiving device comprises:

a transceiver configured to emit and receive the acoustic waves; and a memory configured to store the acoustic waves.

15. The system of claim 9, wherein the receiving device is configured to transform the received acoustic waves into first electrical signals and transmit in real time the first electrical signals upstream on the cable.

16. The system of claim 9, wherein the valve is closed.

17. The system of claim 9, wherein the acoustic modem is further in a sleeping mode and the receiving device is configured to wake up the acoustic modem for transmitting the acoustic waves.

18. A method for transmitting data from sensors to a surface of a well in which the sensors are provided, the method comprising:

recording measurements related to the well with the sensors provided in the well and the sensors connected to an acoustic modem;

having the acoustic modem provided in a side pocket of an elongated body of a drill line in the well, in a vicinity of the sensors, in a sleeping mode;

receiving a wake-up signal at the acoustic modem from a receiving device also provided in the well, wherein the receiving device is separated from the acoustic modem by a closed valve, wherein the valve provided in the drill line and the valve is upstream of the drill line;

receiving the measurements from the sensors at the acoustic modem, wherein the acoustic modem is configured to receive electrical signals from the sensors, transform the electrical signals into acoustic signals indicative of the measurements by the sensors;

transmitting the acoustic signals from the acoustic modem to the receiving device through the valve, wherein the receiving device being configured to be lowered with a cable into the drill line within the well, and the receiving device to be positioned upstream the valve; and receiving at the receiving device the acoustic signals while the receiving device is not in direct contact with the drill line provided in the well, and the receiving device hangs freely at an end of a cable, inside the well, within the drill line, wherein the acoustic modem comprises a ceramic element configured to oscillate to produce the acoustic signals, and the ceramic element is directly attached to the elongated body of the drill line that defines a through channel and also includes the side pocket that is open to ambient.

* * * * *